US005683283A

United States Patent [19]

Glynn

[11] Patent Number: 5,683,283

[45] Date of Patent: Nov. 4, 1997

[54] CONSTRUCTION BLOCKS FOR EXTENDED SUPPORT STRUCTURES

[75] Inventor: Kenneth P. Glynn, Raritan Township, Hunterdon County, N.J.

[73] Assignee: Ideal Ideas, Inc., Flemington, N.J.

[21] Appl. No.: 210,878

[22] Filed: Mar. 18, 1994

[51] Int. Cl.[6] ..... A63H 33/08

[52] U.S. Cl. ..... 446/128

[58] Field of Search ..... 446/128, 126, 446/127, 125

[56] References Cited

U.S. PATENT DOCUMENTS

| | | | |
|---|---|---|---|
| D. 311,935 | 11/1990 | Andersen . | |
| D. 317,478 | 6/1991 | Larson et al. . | |
| 1,472,536 | 10/1923 | Thomson | 446/126 X |
| 1,996,722 | 4/1935 | Gilbert et al. | 446/126 X |
| 2,406,759 | 9/1946 | Glukes | 446/127 |
| 2,810,233 | 10/1957 | Jakobsen | 446/126 |
| 3,005,282 | 10/1961 | Christiansen . | |
| 3,234,683 | 2/1966 | Christiansen | 446/128 X |
| 3,242,610 | 3/1966 | Christiansen . | |
| 3,405,479 | 10/1968 | Paulson | 446/128 |
| 3,432,960 | 3/1969 | Bombaci | 446/126 |
| 4,701,131 | 10/1987 | Hilderbrandt et al. | 446/126 X |
| 4,744,780 | 5/1988 | Volpe | 446/128 |
| 5,013,245 | 5/1991 | Benedict | 446/126 X |
| 5,071,384 | 12/1991 | Poulsen | 446/128 X |
| 5,282,767 | 2/1994 | Gelardi | 446/126 |

FOREIGN PATENT DOCUMENTS

| | | | |
|---|---|---|---|
| 184497 | 1/1956 | Austria | 446/128 |
| 81057 | 6/1983 | European Pat. Off. | 446/128 |
| 1206687 | 2/1960 | France | 446/128 |
| 2200275 | 7/1972 | Germany | 446/125 |
| 1603668 | 7/1973 | Germany | 446/125 |
| 908097 | 10/1962 | United Kingdom | 446/128 |

*Primary Examiner*—D. Neal Muir

*Attorney, Agent, or Firm*—Kenneth P. Glynn, Esq.

[57] ABSTRACT

The present invention involves a toy construction block which includes a main outer structure having a top, four sidewalls and an open bottom. The top has a plurality of symmetrically arranged elongated projections for interlocking with Other, similar blocks and the open bottom has an underside to the top which itself has an elongated friction post extending therefrom. The friction post is hollow and is centrally and symmetrically located on the underside. The critical features are that the top has thereon a top recess in alignment with the friction post, a bottom recess within the friction post of the block, and at least one of the four sidewalls has a side recess therein adapted to receive an interblock connector. In preferred embodiments, a plurality of the four sidewalls has a side recess therein, and the top recess and bottom recess are formed by a continuous and complete orifice or hole directly through the block vertically.

20 Claims, 5 Drawing Sheets

CONSTRUCTION BLOCKS FOR EXTENDED SUPPORT STRUCTURES

BACKGROUND OF THE INVENTION

1. Field of the Invention

The present invention involves toy construction blocks which have a main outer structure with a top, an open bottom and four sidewalls, and with projections on the top for interlocking with other, similar blocks. More specifically, the present invention has both vertical and horizontal orifices or recesses for inserting ends of various interblock connectors.

2. Information Disclosure Statement

Toy blocks have been around for perhaps more than a century. Plastic snap-in blocks have likewise existed for many decades. Lego™ blocks (Trademark of Interlego, A. G., offices in Enfield, Conn.), have been popular for decades.

U.S. Pat. No. Des. 311,935 shows a toy building element that includes a block base and a column, but this is a single unit with no horizontal members.

U.S. Pat. No. Des. 317,478 shows a toy building element that is an elongated open webbed block which apparently acts to extend the height of toy construction blocks, but, again there is no provision for horizontal extensions or connectors.

U.S. Pat. No. 3,242,610 shows a flexible connector for toy blocks but does not show a sidewall or top insertion of the flexible extension.

U.S. Pat. No. 3,005,282, issued on Oct. 24, 1961 describes interlocking blocks with symmetric protrusions and FIG. 12 shows a cut view of a block with a vertical orifice therethrough. However, there is no teaching or showing of interconnectors, nor is there any suggestion or teaching for recesses on sidewalls as used in the present invention.

SUMMARY OF THE INVENTION

The present invention involves a toy construction block which includes a main outer structure having a top, four sidewalls and an open bottom. The top has a plurality of symmetrically arranged elongated projections for interlocking with other, similar blocks and the open bottom has an underside to said top which itself has an elongated friction post extending therefrom. The friction post is hollow and is centrally and symmetrically located on the underside. The critical features are that the top has thereon a top recess in alignment with the friction post, a bottom recess within the friction post of the block, and at least one of the four sidewalls has a side recess therein adapted to receive an interblock connector. In preferred embodiments, a plurality of the four sidewalls has a side recess therein, and the top recess and bottom recess are formed by a continuous and complete orifice or hole directly through the block vertically.

BRIEF DESCRIPTION OF THE DRAWINGS

The present invention will be more fully understood when the specification herein is taken in conjunction with the drawings appended hereto, wherein.

DETAILED DESCRIPTION OF THE PRESENT INVENTION

Figure 1:
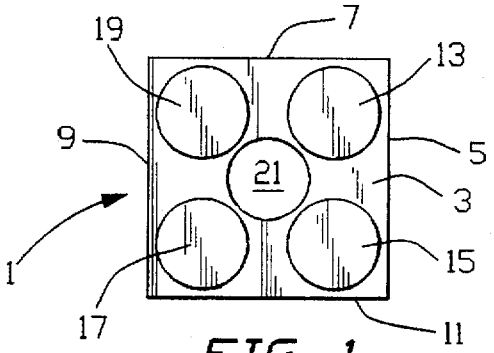
FIGS. 1, 1*a*, 1*b* and 1*c* show various top views of a present invention toy construction block having a circular top orifice, rectangular top orifice, square top orifice and triangular top orifice, respectively.
Figure 1A:
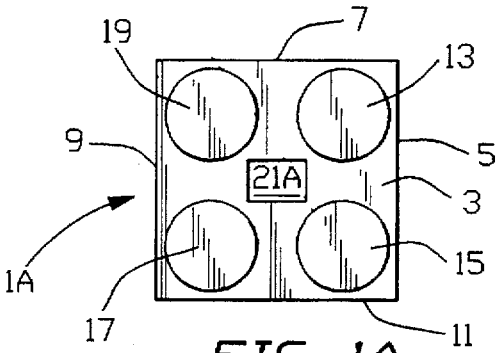
Figure 1B:
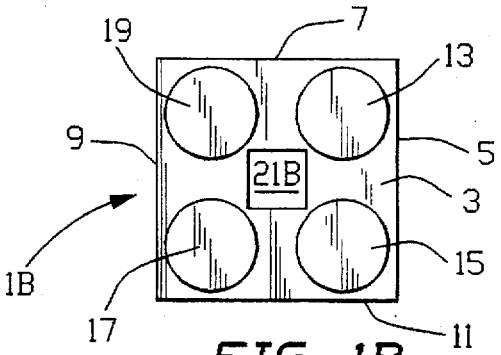
Figure 1C:
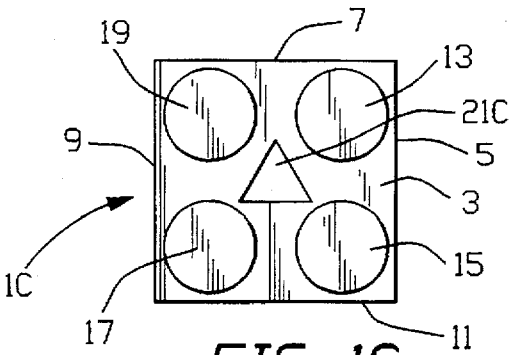
Figure 2:
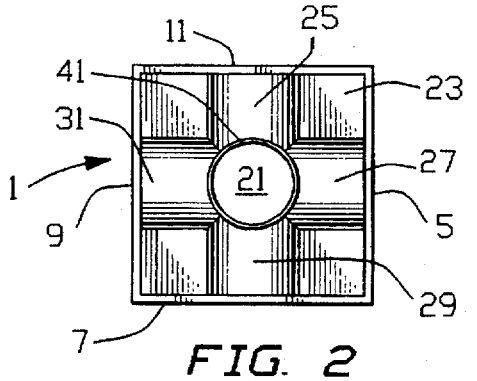
FIG. 2, 2*a*, 2*b* and 2*c* show bottom views of the respective toy construction blocks of FIGS. 1–1*c;*
Figure 2A:
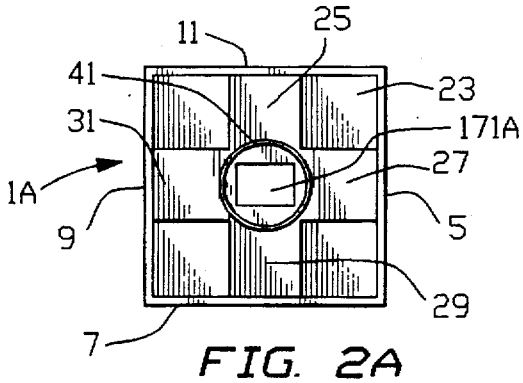
Figure 2B:
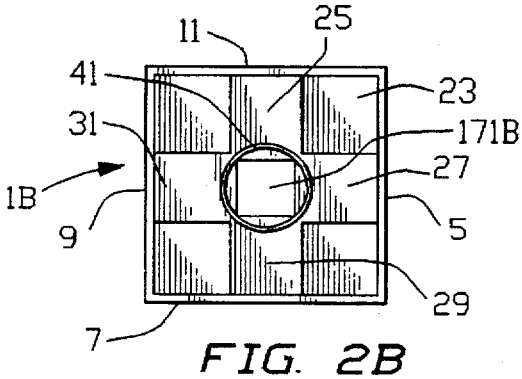
Figure 2C:
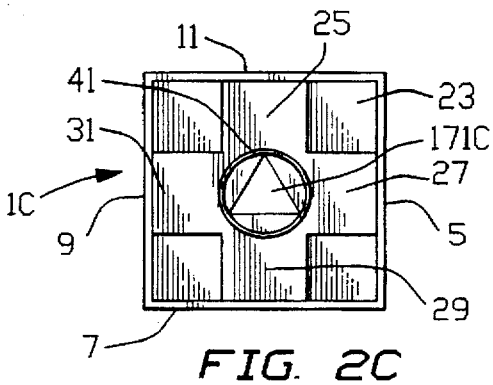

FIGS. 1, 1*a*, 1*b* and 1*c* show a top view of toy construction block 1 which has a main outer structure with a top 3 and four sidewalls 5, 7, 9 and 11. For purposes of brevity, like parts in each of FIGS. 1*a*–1*c*, 2*a*–2*c* and 3*a*–3*c* are labelled with like numbering of FIGS. 1, 2 and 3. Top 3 includes four protrusions 13, 15, 17 and 19 which, in this case are symmetrically arranged and are adapted to interlock with other, similar blocks. Located in the center of top 3 is an open recess, i.e., orifice 21, 21*a*, 21*b* and 21*c*. As shown in FIGS. 1–1*c* and 2–2*c*, orifices 21, 21*a*, 21*b* and 21*c* specifically pass entirely through block 1, but could alternately be closed off or truncated so as to be two recesses with end surfaces. In the case of FIGS. 1*a*–1*c*, the blocks comprise top orifices 21*a*, 21*b*, 21*c* and bottom orifices 171*a*, 171*b*, 171*c*.

Referring to FIGS. 1–1*c*, 2–2*c* and 3–3*c* together, with all identical parts being identically numbered, note that there are four partial tubular members 25, 27, 29 and 31 on recessed bottom 23. Friction post 41 extends from recessed bottom 23 with orifice 21 (FIGS. 2 and 3), and orifices 171*a*, 171*b*, 171*c* (FIGS. 2*a*–2*c*, 4*a*–4*c*). The friction post 41, thus can have an internal cross-section or bottom recess of a variety of shapes not only including a circle 21, but also a rectangle 171*a*, a square 171*b* and a triangle 171*c*, with the top orifice being of a matching configuration 21, 21*a*, 21*b*, 21*c*, respectively, as shown in FIGS. 1*a*–1*c*, 2*a*–2*c*, and 3*a*–3*c*. Sidewalls, that is, sidewalls 5, 7, 9 and 11, have recesses therein as exemplified by recesses 33, 33*a*, 33*b*, 33*c* in sidewall 11 which have respective end surfaces 35, 35*a*, 35*b*, 35*c*.

Figure 3:
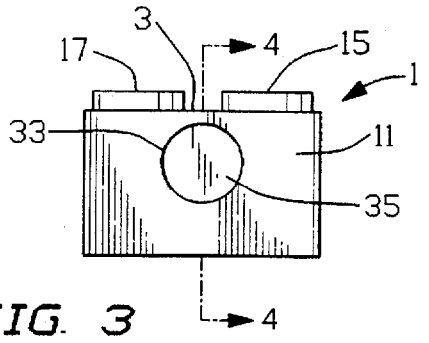
FIGS. 3, 3*a*, 3*b*, and 3*c* show side views of the respective toy construction blocks of FIGS. 1–1*c* having a circular side recess, rectangular side recess, square side recess, and triangular side recess, respectively.
Figure 3A:
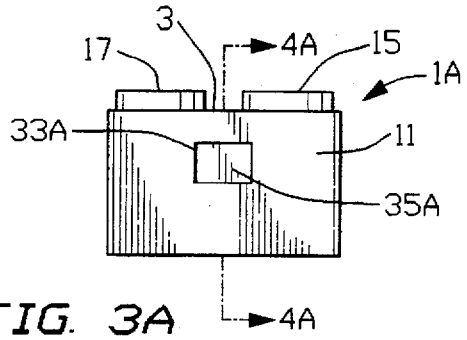
Figure 3B:
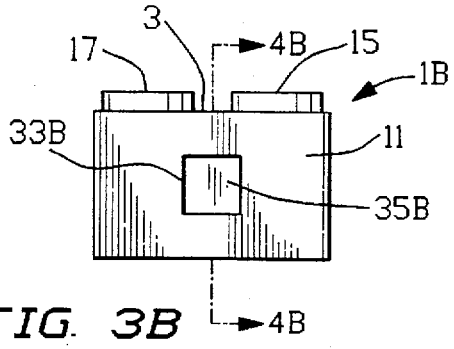
Figure 3C:
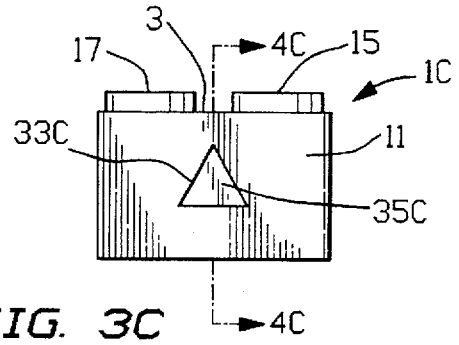
Figure 4:
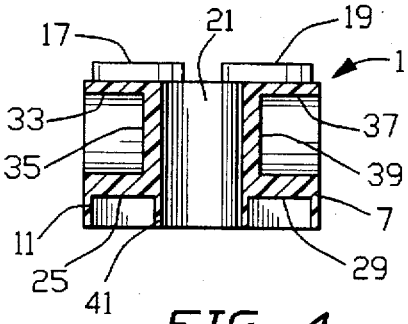
FIGS. 4, 4*a*, 4*b* and 4*c* show side cut views of the respective toy construction blocks of FIGS. 1–1*c;*
Figure 4A:
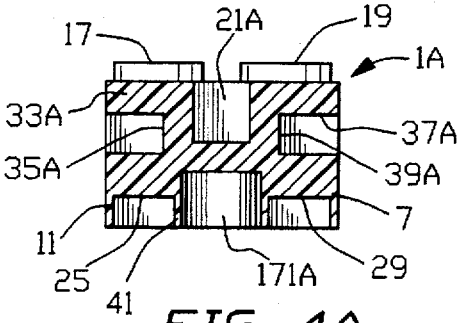
Figure 4B:
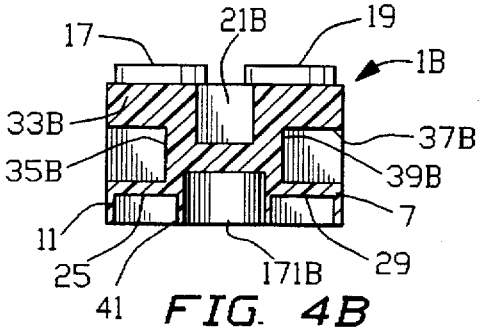
Figure 4C:
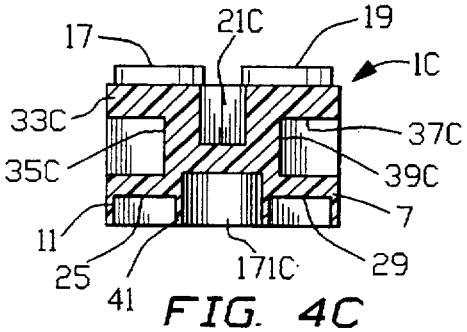

FIGS. 4–4*c* show cut views of blocks 1–1*c* shown in FIGS. 1–1*c*, 2–2*c* and 3–3*c* at cut line 4—4 shown in FIGS. 3–3*c*. Identical aspects to those shown in previous Figures are identically numbered. Here two side recesses 33 and 37 are shown, as well as orifice 21 which, in essence is a top open recess and a bottom open recess formed by the continuous orifice 21 which, as shown, forms a complete vertical passthrough, including being a part of a hollow area of friction post 41.

FIGS. 4*a*–4*c* show side cut views of block 1 in FIGS. 1*a*–1*c*, 2*a*–2*c* and 3*a*–3*c* at cut line 4—4 shown in FIGS.

3a–3c. Here pairs of side recesses 33a–33c and 37a–37c are shown, as well as orifices 21a–21c which are top open recesses that form a complete vertical passthrough with respective bottom open recesses 171a–171c, including being part of a hollow area of friction post 41.

Figure 5:
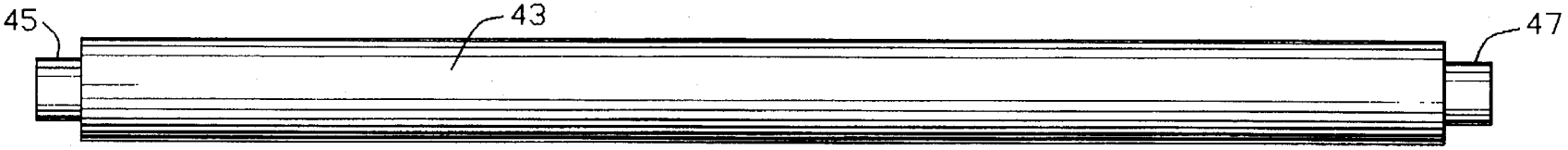
FIGS. 5 and 6 show a side view and an end view of an interblock connector used in conjunction with the present invention toy constructions blocks.
Figure 6:
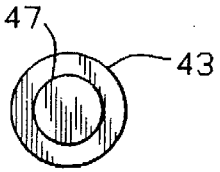
Figure 7:
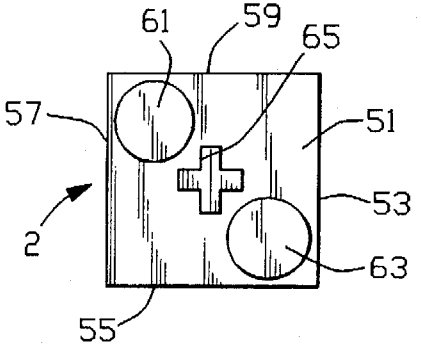
FIGS. 7, 8 and 9 show a top, a bottom and a side view, respectively, of an alternative present invention toy construction block.
Figure 8:
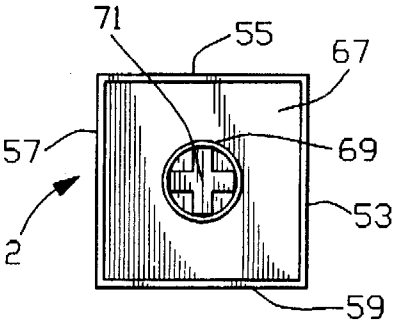

FIGS. 5 and 6 show a side view and end view respectively of interblock connector 43 with connection plugs 45 and 47. Interblock connector 43 may be utilized as a horizontal or as a vertical connector, for example connection plug 45 may be inserted in the top 3 of block 1 by being tightly fitted into orifice 21 to create an outward vertical column or, conversely, may be inserted in the bottom 23, within friction post 41, into orifice 21 to created a downwardly projecting column. Alternatively, interblock connector 43 could be inserted into any one of the sidewall recesses such as recess 33 inside wall 11 of block 1. Clearly, additional blocks may be snapped into block 1 after it is connected to interblock connector 43 and a similar block could be connected to interblock 43 at its opposite connection plug 47.

Figure 9:
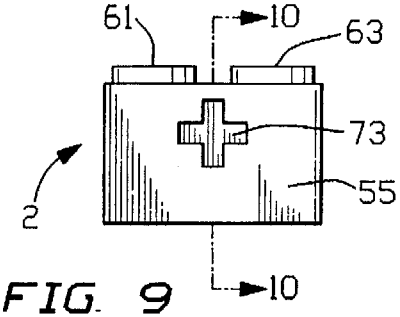
Figure 10:
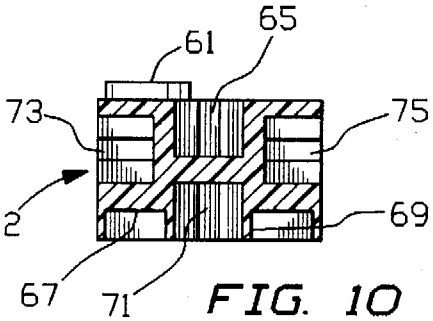
FIG. 10 shows a side cut view of the present invention toy construction block shown in FIGS. 7, 8 and 9.

Referring now to FIGS. 7, 8, 9 and 10 respectively, there is shown a top, bottom, side and side cut view of alternative embodiments toy construction block 2. Here, top 51 includes only two projections 61 and 63 for interlocking with similar blocks by fitting with bottom edges and a friction post. Top 51 also includes recess 65 which does not pass completely through block 2 and, unlike the circular orifice 21 of block 1 shown in the previous figures, recess 65 has a cross-configuration. Block 2 has sidewalls 53, 55, 57 and 59 and a bottom 67 with friction post 69 extending therefrom and a bottom recess 71, also in the form of a cross. As shown in FIG. 9, sidewall 55 has a recess 73 which is likewise in the form of a cross. The cut side view shown in FIG. 10 of device 2 is taken along cut line 10—10 shown in FIG. 9 and here exposes top recess 65, bottom recess 71, and sidewall recesses 73 and 75 as shown.

Figure 11:
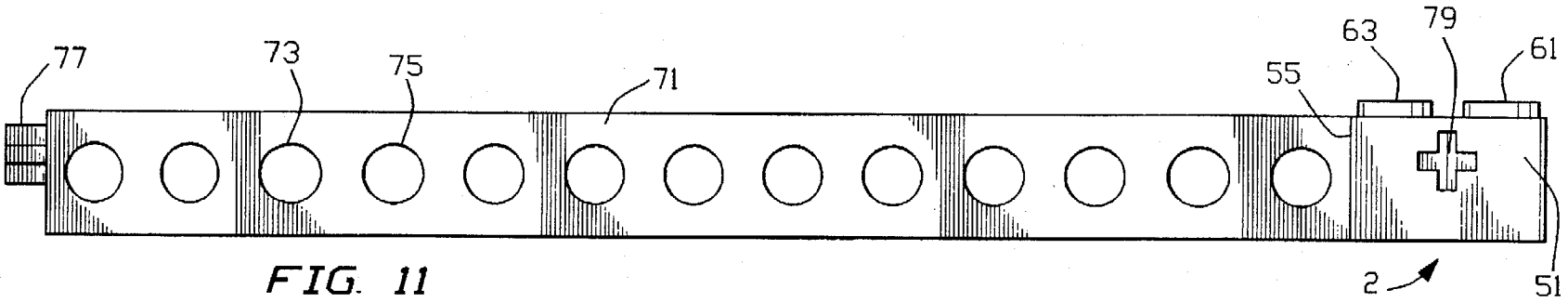
FIGS. 11 and 12 show a side and a top view of one toy construction block of the present invention connected to one end of an interblock connector used therewith.
Figure 12:
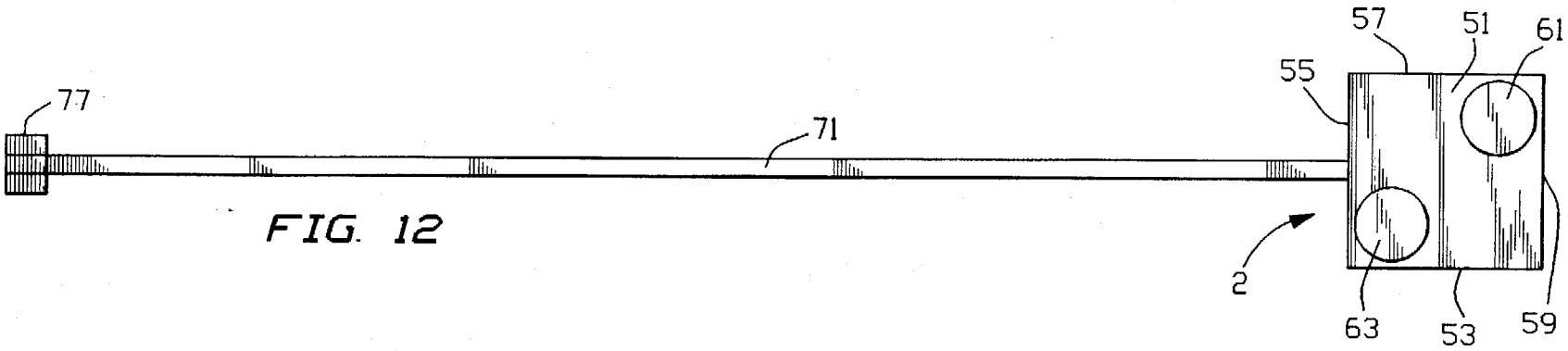

FIGS. 11 and 12 show a side view and a top view of an interblock connector 71 inserted into the criss-cross recess 73 of sidewall 55 of block 2 shown in the previous four figures. Note also, that sidewall 51 includes a side recess 79. All parts identical to those shown in FIGS. 7, 8, 9 and 10 are identically numbered. Interblock connector 73, in this case, is a flat beam with cross-type connection projections at each end (one not shown inserted into block 2), with connection plug 77 shown. Interblock connector 71 has a series of orifices such as orifices 73 and 75 and these may be used to receive blocks such as block 2 on a diagonal so as to create a 45° angle for construction of bridges, robots, cranes, slanted roofs, etc. or may be used to receive blocks such as block 1 shown in FIG. 1 for lateral stacking or interconnecting of additional blocks. Significantly, interconnector 71 may also be used with other types of existing toys such as metal erection sets which have orifices for screws and nuts and the present invention blocks will thus enable a user to now interconnect construction block toys with metal girder toys and plastic extender toys sold under various tradenames and are well known to the artisan.

Figures 13, 14:
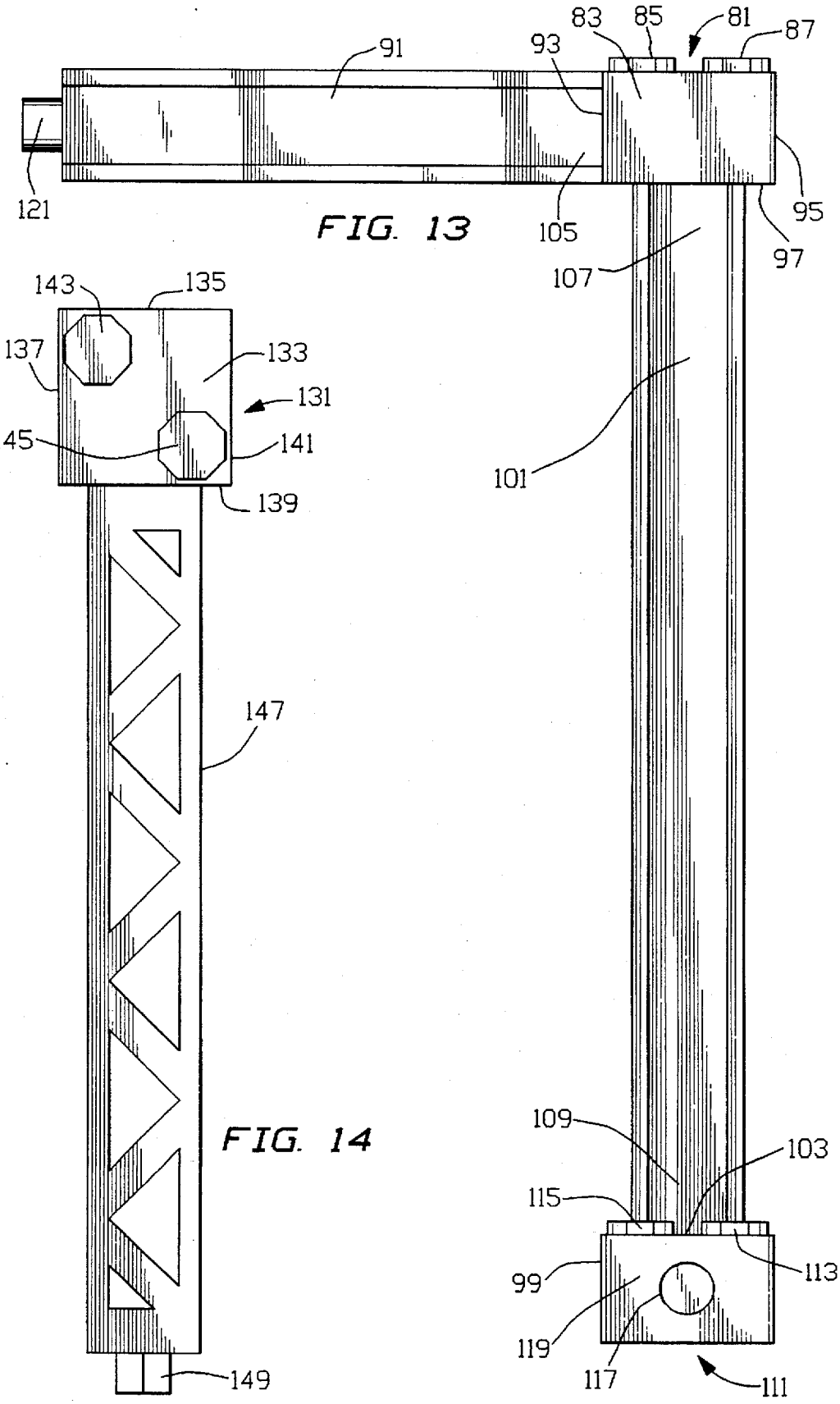
FIG. 13 shows a side view of a partially constructed component which may be created with present invention toy construction blocks which include both vertical and horizontal interblock connectors; and, FIG. 14 shows a top view of a present invention alternative toy construction block with an interblock connector.

FIG. 13 shows a side view of a partially complete construction component and includes present invention blocks 81 and 111 and I-beams 91 and 101. Here, construction blocks 81 and 111 include hexagonally cut projections 85 and 87, and 113 and 115, respectively. Block 81 does not have four sidewall recesses, but has only three, one being on the left sidewall 93, one being on the back sidewall (not shown) and one being on sidewall 95. It can be deduced from the fact that beam 91 is inserted into block 81 at sidewall 93, that sidewall 93 contains a circular recess. Note that beam 91, at its end 105 would include an insertion connector such as insertion connector 121 shown at the opposite end thereof. On the underside 97 of block 81, top 107 of beam 101 is inserted therein by being inserted into a recess located in a friction post (not shown). At the bottom end 109 of beam 101, beam 101 is inserted into block 111. Block 111 includes sidewalls 99 and 119 and side recess 117, as shown. As can now be seen by virtue of the representation in FIG. 13, present invention toy construction blocks can be used to make horizontally and vertically extended construction projects so as to make open skyscrapers, amusement park type structures, bridges, cranes, robots, abstractions of art and the like.

FIG. 14 shows a top view of present invention toy construction block 131 connected to girder 147. Girder 147 has a diamond-type connection plug 149 and, at its opposite end is inserted into block 131. Block 131 includes top 133 with hexagonal projections 143 and 145 as shown and has sidewalls 135, 137, 139 and 141, as shown.

Obviously, numerous modifications and variations of the present invention are possible in light of the above teachings. It is therefore understood that within the scope of the appended claims, the invention may be practiced otherwise than as specifically described herein.

What is claimed is:

1. A toy construction unit, comprising:

(a) a block having a top, four sidewalls and an open bottom, said top having a plurality of symmetrically arranged elongated projections for interlocking with other, similar blocks; said open bottom exposing an underside to said top; and underside of said top having an elongated friction post extending therefrom, said friction post being hollow and being centrally and symmetrically located on said underside, said friction post further having a bottom recess therein; and at least one of said four sidewalls having a side recess therein, said bottom recess and said side recess adapted to receive an interblock connector; and (b) an interblock connector, said interblock connector having an elongated body and first and second ends, wherein at least one of said first and second ends has means for interconnecting to one of said recesses of said block.

2. The toy construction unit of claim 1, wherein said side recess is rectangular.

3. The toy construction unit of claim 1, wherein said side recess is square.

4. The toy construction unit of claim 1, wherein said side recess is triangular.

5. The toy construction unit of claim 1, wherein said side recess is of a cross configuration.

6. The toy construction unit of claim 1, wherein at least two of said sidewalls have side recesses therein.

7. The toy construction unit of claim 1, wherein at least three of said sidewalls have side recesses therein.

8. The toy construction unit of claim 1, wherein all of said sidewalls have side recesses therein.

9. The toy construction unit of claim 1, wherein said top has thereon a top recess in alignment with said friction post, said top recess, said bottom recess and said side recess being adapted to receive said at least one end of said interblock connector; and further wherein said top recess, said bottom recess and said side recess are of a same shape, said shape being selected from the group consisting of circles, rectangles, squares, triangles and crosses.

10. A toy construction unit, comprising:

(a) a block having a top, four sidewalls and an open bottom, said top having a plurality of symmetrically arranged, elongated projections for interlocking with other, similar blocks; said open bottom exposing an underside to said top; the underside of said top having an elongated friction post extending therefrom, said friction post being hollow and being centrally and symmetrically located on said underside; said top having thereon a top recess in alignment with said friction post; said friction post having a bottom recess therein, and at least one of said four sidewalls having a side recess therein, said top recess, said bottom recess and said side recess adapted to receive an interblock connector; and (b) an interblock connector, said interblock connector having an elongated body and first and second ends, wherein at least one of said first and second ends has means for interconnecting to one of said recesses of said block.

11. The toy construction unit of claim 10, wherein said friction post is externally and internally cylindrical and said top orifice is circular.

12. The toy construction unit of claim 10, wherein said elongated body of said interblock connector further comprises means for connecting to said block.

13. The toy construction unit of claim 12, wherein said means for connecting is a plurality of orifices that interconnect to one of said symmetrically arranged, elongated projections.

14. A toy construction unit, comprising:

(a) a block having a top, four sidewalls and an open bottom, said top having a plurality of symmetrically arranged, elongated projections for interlocking with other, similar blocks; said open bottom exposing an underside to said top; the underside of said top having an elongated friction post extending therefrom, said friction post being hollow and being centrally and symmetrically located on said underside; said top having thereon a top recess in alignment with said friction post; said friction post having a bottom recess therein, and at least one of said four sidewalls having a side recess therein, said top recess, said bottom recess and said side recess adapted to receive an interblock connector; and (b) an interblock connector, said interblock connector having an elongated body and first and second ends, wherein at least one of said first and second ends has means for interconnecting to one of said recesses of said block; and wherein said elongated body of said interblock connector further comprises means for connecting to said block; said means for connecting comprising a plurality of orifices for interconnecting to one of said symmetrically arranged, elongated projections.

15. The toy construction unit of claim 14, wherein said top recess and said bottom recess are formed by a single straight through vertical orifice running from the top of said block through said friction post.

16. The toy construction unit of claim 14, wherein said friction post has a rectangular internal cross-section and said top orifice is rectangular.

17. The toy construction unit of claim 14, wherein said friction post has a square internal cross-section and said top orifice is square.

18. The toy construction unit of claim 14, wherein said friction post has a triangular internal cross-section and said top orifice is triangular.

19. The toy construction unit of claim 14, wherein said side recess is selected from the group of shapes consisting of a circle, a square, a triangle and a cross.

20. The toy construction unit of claim 14, wherein all of said sidewalls have side recesses therein.

* * * * *